US010463117B2

(12) United States Patent
Jarecki

(10) Patent No.: US 10,463,117 B2
(45) Date of Patent: Nov. 5, 2019

(54) OPERABLE BRACELET

(71) Applicant: Carl Jarecki, Costa Mesa, CA (US)

(72) Inventor: Carl Jarecki, Costa Mesa, CA (US)

( * ) Notice: Subject to any disclaimer, the term of this patent is extended or adjusted under 35 U.S.C. 154(b) by 126 days.

(21) Appl. No.: 15/683,973

(22) Filed: Aug. 23, 2017

(65) Prior Publication Data

US 2018/0055157 A1 Mar. 1, 2018

Related U.S. Application Data

(60) Provisional application No. 62/379,252, filed on Aug. 25, 2016.

(51) Int. Cl.

| | |
|---|---|
| ***A44C 5/00*** | (2006.01) |
| ***A45D 8/36*** | (2006.01) |
| *A45D 8/00* | (2006.01) |
| *A45F 5/00* | (2006.01) |
| *A44C 15/00* | (2006.01) |

(52) U.S. Cl.

CPC ..... *A44C 5/0007* (2013.01); *A45D 8/36* (2013.01); *A44C 5/0069* (2013.01); *A44C 15/003* (2013.01); *A45D 2008/004* (2013.01); *A45F 2005/008* (2013.01)

(58) Field of Classification Search

CPC ... A44C 5/0007; A44C 15/003; A44C 5/0069; A44C 1/00; A44C 5/00; A44C 5/0023; A44C 5/0053; A44C 5/0084; A44C 5/0092; A44C 9/0084; A44C 9/0092; A45D 2008/004; A45D 8/36; A45F 2005/008; A41D 20/00; G09F 3/005

USPC ..... 63/1.18, 3, 15, 40; D11/4, 3, 5; 24/3.2; 132/273, 375, 333; 248/682

See application file for complete search history.

(56) References Cited

U.S. PATENT DOCUMENTS

| | | | | | |
|---|---|---|---|---|---|
| 1,938,206 | A * | 12/1933 | Bigney | A44C 5/0092 | 63/3 |
| 2,522,852 | A * | 9/1950 | Apps | A44C 5/0092 | 63/7 |
| 3,559,854 | A * | 2/1971 | Loveland | A44C 5/003 | 132/294 |
| D733,733 | S * | 7/2015 | Bae | D14/486 | |
| D757,593 | S * | 5/2016 | Dulien | D11/4 | |
| D758,908 | S * | 6/2016 | Waud | A44C 5/003 | D11/3 |
| 2014/0318180 | A1* | 10/2014 | Cabe | A44C 5/0007 | 63/5.1 |
| 2015/0359304 | A1* | 12/2015 | Thomas | A44C 17/0208 | 63/1.11 |
| 2016/0166017 | A1* | 6/2016 | Zannella | A44C 5/0007 | 63/1.11 |

(Continued)

*Primary Examiner* — William V Gilbert

(57) ABSTRACT

Disclosed is an operable bracelet. The operable bracelet enables a user to wrap around the operable bracelet on a body part of the user to support at least one hair accessory. The operable bracelet comprising a bracelet body having an oval or a circular shape; at least one retaining feature extended along with circumference of outer side of the operable bracelet to accommodate the at least one hair accessory; at least one elevated feature positioned on outer side of the operable bracelet in parallel to the at least one retaining feature and elevated above the bracelet body, configured to elevated the at least one hair accessory from the at least one retaining feature to make the at least one hair accessory accessible for removal.

6 Claims, 4 Drawing Sheets

(56) References Cited

U.S. PATENT DOCUMENTS

2016/0295974 A1* 10/2016 Serfass ..... A44C 5/0007
2017/0181509 A1* 6/2017 Ingimundarson ..... A44C 5/003

* cited by examiner

OPERABLE BRACELET

CROSS-REFERENCE TO RELATED APPLICATION

The present application is related to U.S. provisional patent application No. 62/379,252, filed on Aug. 25, 2016. The entire disclosure of the above patent application is hereby incorporated by reference.

TECHNICAL FIELD OF THE INVENTION

The present application generally relates to the field of wearable wrap around. Particularly, the application provides an operable bracelet. More particularly, the application provides an operable bracelet enabling a user to wrap around the operable bracelet on a body part of the user to support a hair accessory.

BACKGROUND

Recent time has witnessed a considerable evolution in fashion industry, focusing on individual users. There has been a considerable industrial effort to develop various devices and solutions to manage accessories for various body parts of users, such as hair, particularly for women users. More specifically, hair ties have been known to be a necessity for women users and managing hair tie is one of the know challenges in the technical domain.

The prior arts disclose various solutions, such as having hair tie on woman's wrist, however, due to the unpleasant and unattractive nature; it may not be a preferable option for women users to wear hair ties directly on their wrist, which eventually resulting in losing their hair ties when they need them most. Prior art solutions, such as hair ties when worn on the wrist may be tight due to the elastic properties resulting in cutting off circulation and leaving behind indentations. In addition, hair ties directly attached to user's wrist over time may carry harmful bacteria; introduce allergies and other skin inflammations, thereby posing health risk for user, Thus, in the light of the above mentioned background art, it is evident that, there is a need a solution for women's everyday active lifestyle which enables them to keep their hair tie when they need it most in a hygienic manner. There exists a need for an operable bracelet, wearable by the users on body part such as wrist, accommodating hair ties. An operable bracelet is desired.

SUMMARY

Before the present systems and methods, enablement are described, it is to be understood that this application is not limited to the particular systems, and methodologies described, as there can be multiple possible embodiments which are not expressly illustrated in the present disclosures. It is also to be understood that the terminology used in the description is for the purpose of describing the particular versions or embodiments only, and is not intended to limit the scope of the present application.

In accordance with the present application, the primary objective is to provide an operable bracelet.

Another objective is to provide an operable bracelet, enabling a user to wrap around the operable bracelet on a body part of the user, such as wrist to support at least one hair accessory, such as hair tie in a hygienic manner.

In an embodiment of the present invention, an operable bracelet (100) is provided.

In an embodiment of the present invention, the operable bracelet (100) is provided, enabling a user to wrap around the operable bracelet (100) on a body part of the user to support at least one hair accessory (104). The operable bracelet comprising a bracelet body (106); at least one retaining feature (108); and at least one elevated feature (110). The bracelet body (106) of the operable bracelet (100) having an oval or a circular shape; the at least one retaining feature (108) extended along with circumference of outer side of the operable bracelet (100) to accommodate the at least one hair accessory (104); the at least one elevated feature (110) positioned on outer side of the operable bracelet (100) in parallel to the at least one retaining feature (108) and elevated above the bracelet body (106), configured to elevated the at least one hair accessory (104) from the at least one retaining feature (108) to make the at least one hair accessory (104) accessible for removal.

In an embodiment of the present invention, the bracelet body (106) of the operable bracelet (100) further comprises of a base layer (112); and a partial encapsulation layer (114) bonded by a process resulting in the bracelet body (106) of the operable bracelet (100).

The operable bracelet disclosed herein may be implemented in any means for achieving various aspects and may be implemented to perform in various ways. Other features will be apparent from the accompanying drawings and from the detailed description that follow.

BRIEF DESCRIPTION OF THE DRAWINGS

The foregoing summary, as well as the following detailed description of preferred embodiments, is better understood when read in conjunction with the appended drawings. There is shown in the drawings example embodiments, however, the application is not limited to the specific system and method disclosed in the drawings.

DETAILED DESCRIPTION

Figure 1:
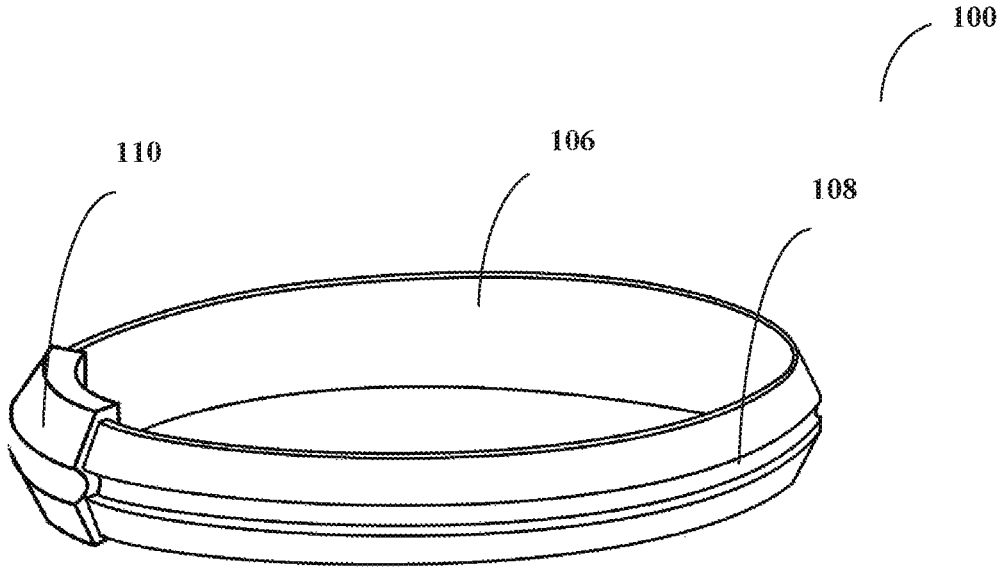
FIG. 1: illustrates an operable bracelet, in accordance with an embodiment of the present subject matter.

In the following detailed description of the embodiments of the present subject matter, references are made to the accompanying drawings that form a part hereof, and in which are shown by way of illustration specific embodiments in which the present subject matter may be practiced. These embodiments are described in sufficient detail to enable those skilled in the art to practice the present subject matter, and it is to be understood that other embodiments may be utilized and that changes may be made without departing from the scope of the present subject matter. The following detailed description is, therefore, not to be taken in a limiting sense, and the scope of the present subject matter is defined by the appended claims.

Some embodiments, illustrating its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise. Although any methods, and systems similar or equivalent to those described herein can be used in the practice or testing of embodiments, the preferred methods, and systems are now described. The disclosed embodiments are merely exemplary.

In an embodiment of the present invention, an operable bracelet (100) is provided. The operable bracelet (100) enabling a user to wrap around the operable bracelet (100) on a body part of the user, such as wrist (102) to support at least one hair accessory (104), such as hair tie.

In an embodiment of the present invention, the operable bracelet (100) may comprise of a bracelet body (106); at least one retaining feature (108); and at least one elevated feature (110). The bracelet body (106) of the operable bracelet (100) may have an oval or a circular shape. The at least one retaining feature (108) may be extended along with circumference of outer side of the operable bracelet (100) to accommodate the at least one hair accessory (104). The at least one elevated feature (110) may be positioned on outer side of the operable bracelet (100) in parallel to the at least one retaining feature (108) and elevated above the bracelet body (106), and may be configured to elevated the at least one hair accessory (104) from the at least one retaining feature (108) to make the at least one hair accessory (104) accessible for removal.

In an embodiment of the present invention, the bracelet body (106) may further comprise of a base layer (112); and a partial encapsulation layer (114) may be bonded by a process resulting in the bracelet body (106) of the operable bracelet (100). The base layer (112) and the partial encapsulation layer (114) may be bonded by a manufacturing process selected from a group comprising an injection molding, a compression molding or a combination thereof resulting in the complete main body of the operable bracelet (100).

In an embodiment of the present invention, the operable bracelet (100) may be manufactured from a material selected from a group comprising but not limited to medical grade silicon, fluoroelastomer, or any suitable elastomers.

In an exemplary embodiment of the present invention, the medical grade silicon may be durometer of 70, to keep the operable bracelet (100) safe, flexible, durable, and soft so as to provide user with maximum comfort. The durometer of the base layer (112); and the partial encapsulation layer (114) may be same or different. For an example durometer of the base layer (112) may be 70; durometer the partial encapsulation layer (114) may be 40; and durometer of the at least one elevated feature (110) may be 50. The operable bracelet (100) may have a sturdy structure with durometer of 70, so as to prevent indentations of at least one hair accessory (104). The operable bracelet (100) may be manufactured as water and sweat resistance, thereby the operable bracelet (100) may be worn in shower, pool, ocean and alike water bodies. The operable bracelet (100) may be manufactured as hypoallergenic so as to eliminate any potential allergic reaction on user skin of all types.

In an embodiment of the present invention, the operable bracelet (100) may be applied with a plurality of high resolution imagery or logo for branding purposes, wherein the plurality of high resolution imagery or logo may be selected from a group comprising but not limited to high resolution imagery or logo representing specific team colors; lights out; illumination; neon lights; country support; translucent; UV powered; glowing; and charity causes.

Referring to FIG. 1 illustrates an operable bracelet, in accordance with an embodiment of the present subject matter.

In another embodiment of the present invention, the operable bracelet (100) is provided that may enable a user to wrap around the operable bracelet (100) on a body part of the user to support at least one hair accessory (104). The operable bracelet (100) may comprise of the bracelet body (106); at least one retaining feature (108); and at least one elevated feature (110). The operable bracelet (100) shape may be selected from a group comprising but not limited to oval, and circular shape. The operable bracelet (100) may have oval shape, so as to make the operable bracelet (100) a comfortable and perfect fit close to user wrist (102) (not shown in the FIG. 1) to support at least one hair accessory (104) (not shown in the FIG. 1), such as hair tie. The at least one retaining feature (108) may be positioned on the outer side of the operable bracelet (100), the at least one retaining feature (108) for the greater part extends along with a circumference of the outer side of the operable bracelet (100). The at least one retaining feature (108) may be a channel and the channel terminates at the beginning and end of the at least one elevated feature (110) break points, wherein the hair accessory (104) may be arranged to extend over the at least one elevated feature (110). The at least one elevated feature (110) may be positioned on the outer side of the operable bracelet (100) in parallel to the at least one retaining feature (108) that elevates above the bracelet body (106). The at least one elevated feature (110) may be configured to function as a point where the hair accessory (104) may be elevated from the at least one retaining feature (108) to make the hair accessory (104) accessible for removal. The at least one elevated feature (110) may present two break points, right and left break point in-between the beginning and end parts of the partial encapsulation layer (114) (not shown in the FIG. 1) that may correspond to the at least one retaining feature (108). The hair accessory (104) may be spanning the outside edge of the operable bracelet (100), securely houses within the at least one retaining feature (108) of the operable bracelet (100) and may set within the groove of the at least one elevated feature (110).

Figure 2:
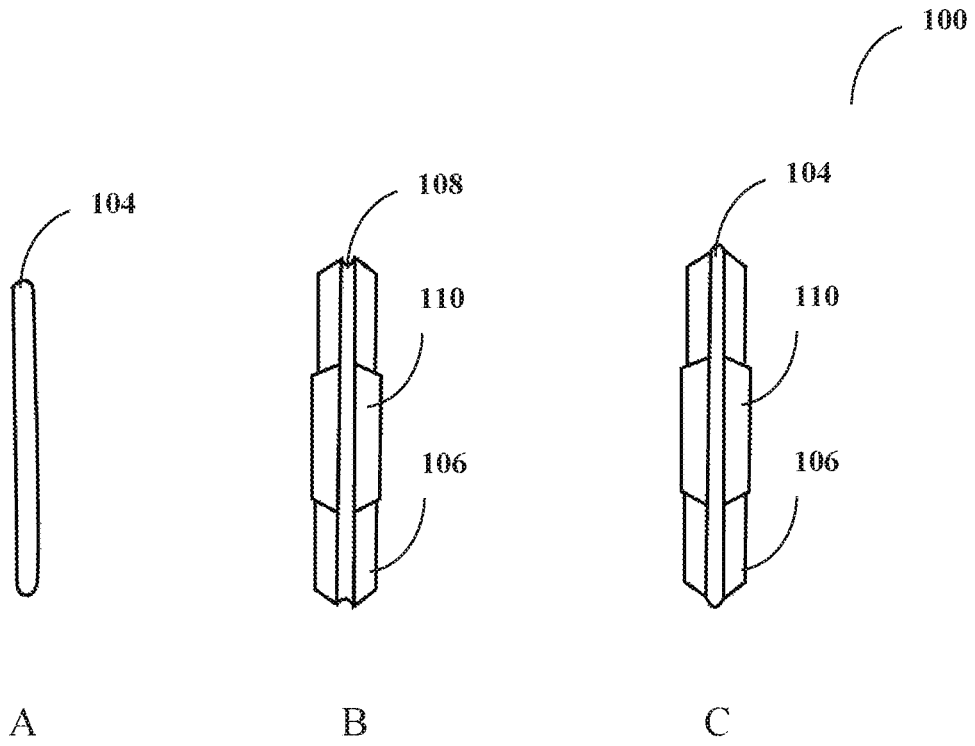
FIG. 2: illustrates a hair accessory (A); side view of an operable bracelet without the hair accessory (B); and side view of an operable bracelet with the hair accessory (C), in accordance with an embodiment of the present subject matter.

Referring to FIG. 2 illustrates a hair accessory (A); side view of an operable bracelet without the hair accessory (B); and side view of an operable bracelet with the hair accessory (C), in accordance with an embodiment of the present subject matter.

In another embodiment of the present invention, the hair accessory (104) is illustrated in FIG. 2 (A). A side view of the operable bracelet (100) without the hair accessory (104) is illustrated in FIG. 2 (B). A side view of the operable bracelet (100) with the hair accessory (104) is illustrated in FIG. 2 (C).

Figure 3A:
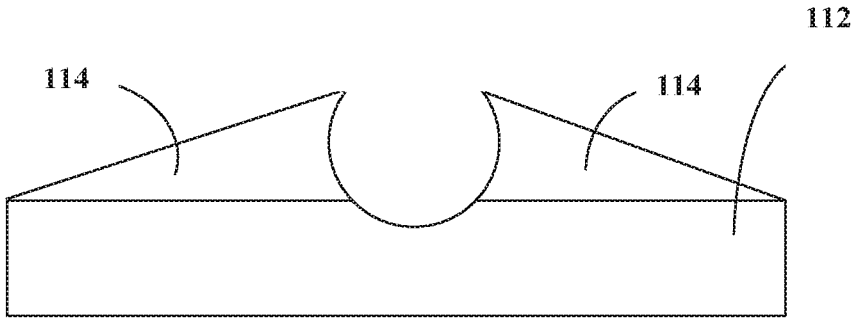
FIGS. 3*a* and 3*b*: illustrates cross section view of an operable bracelet without and with a hair accessory, in accordance with an embodiment of the present subject matter.
Figure 3B:
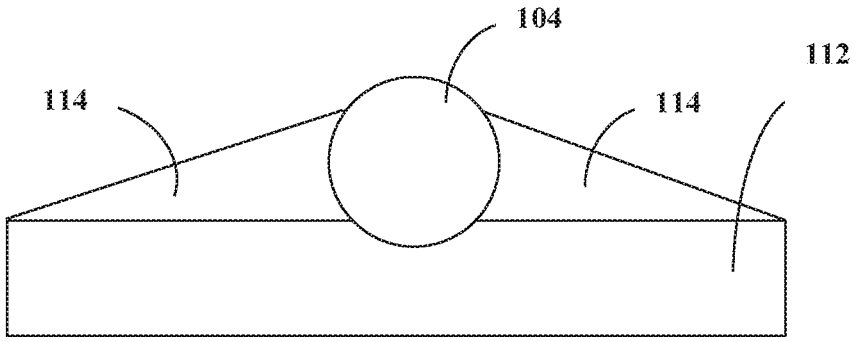

Referring to FIGS. 3*a* and 3*b* illustrates cross section view of an operable bracelet without and with a hair accessory, in accordance with an embodiment of the present subject matter.

In another embodiment of the present invention, the operable bracelet (100) may further comprise of two physical layers, the base layer (112) and the partial encapsulation layer (114) corresponding to the at least one retaining feature (108). The base layer (112) and the partial encapsulation layer (114) may be bonded by a process resulting in the bracelet body (106) of the operable bracelet (100). The base layer (112) and the partial encapsulation layer (114) may be bonded by a manufacturing process selected from a group comprising an injection molding, a compression molding or a combination thereof resulting in the complete main body of the operable bracelet (100). The base layer (112) of the operable bracelet (100) may have a complete circumference channel directly in the middle of the operable bracelet (100) which is part of the at least one retaining feature (108). The partial encapsulation layer (114) may be aligned with the channel of the base layer (112) design in the formation of a major arc. The partial encapsulation layer (114) may be configured to create the at least one retaining feature (108) to accommodate the hair accessory (104) (not shown in the FIGS. 3*a* and 3*b*) therein. The at least one retaining feature (108) may define a left and a right partial encapsulation ledges and configured to form the major arc from one (left or right) partial encapsulation edge to the opposite (right or left) partial encapsulation edge whereas the deepest point of the channel may be located at bottom center of the at least one retaining feature (108). In an alternative embodiment of the present invention, the at least one retaining feature (108) further defines a square shape circumference channel around the operable bracelet (100).

Figure 4A:
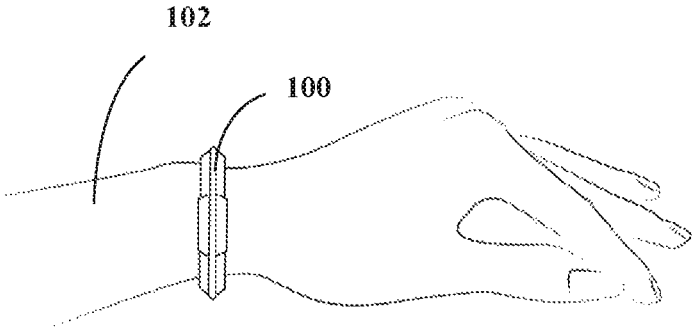
FIGS. 4*a*, 4*b* and 4*c*: illustrates various view of wrist with an operable bracelet, in accordance with an embodiment of the present subject matter.
Figure 4B:
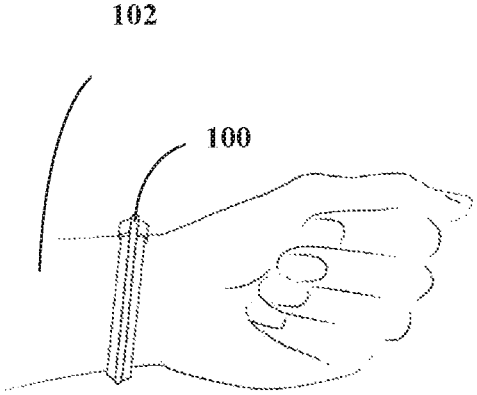
Figure 4C:
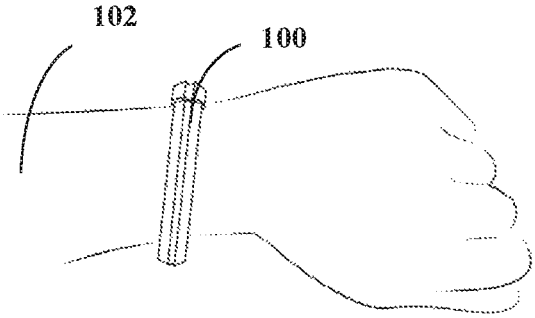

Referring to FIGS. 4*a*, 4*b* and 4*c* illustrates various view of wrist with an operable bracelet, in accordance with an embodiment of the present subject matter.

In another embodiment of the present invention, the operable bracelet (100) may be secured on the wrist (102) with the at least one elevated feature (110) on the inside of the wrist (102) for easy access to the hair accessory (104) for removal, according to the FIGS. 4*a* and 4*b*. The operable bracelet (100) may be secured on the wrist (102) with the at least one elevated feature (110) on the outside of the wrist (102) for easy access to the hair accessory (104) for removal, according to the FIG. 4*c*. While removing the hair accessory (104), the user may access the hair accessory (104) at the at least one elevated feature (110) point and use the process of pulling the hair accessory (104), which may result in the removal of the hair accessory (104) from the at least one retaining feature (108).

The illustrations of arrangements described herein are intended to provide a general understanding of the structure of various embodiments, and they are not intended to serve as a complete description of all the elements and features of apparatus and systems that might make use of the structures described herein. Many other arrangements will be apparent to those of skill in the art upon reviewing the above description. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

The preceding description has been presented with reference to various embodiments. Persons skilled in the art and technology to which this application pertains will appreciate that alterations and changes in the described structures and methods of operation can be practiced without meaningfully departing from the principle, spirit and scope.

What is claimed is:

1. An operable bracelet (100) wearable by a user on a user's wrist to accommodate at least one hair accessory (104), the operable bracelet (100) comprising:

a. a bracelet body (106) having an oval or a circular shape, the bracelet body (106) comprises a base layer (112), and a partial encapsulation layer (114) bonded by a process resulting in the bracelet body (106), wherein the base layer (112) having a channel positioned on an outer side and extending circumferentially through a middle of the base layer (112), and wherein the partial encapsulation layer (114) is aligned with the channel of the base layer (112) to form a major arc;

b. at least one retaining feature (108) that correspond to the base layer (112) and the partial encapsulation layer (114) of the bracelet body (106) to securely accommodate the at least one hair accessory (104); and c. at least one elevated feature (110) having a groove, the elevated feature (110) is positioned on the outer side of the bracelet body (106) and elevated therefrom in parallel to the at least one retaining feature (108) such that when the at least one hair accessory (104) is securely housed within the at least one retaining feature (108), the at least one hair accessory (104) sets within the groove of the at least one elevated feature (110) to extend over the at least one elevated feature (110) to make the at least one hair accessory (104) accessible for removal.

2. The operable bracelet (100) as claimed in claim 1, wherein the at least one elevated feature (110) when positioned on the outer side of the bracelet body (106) and elevated therefrom presents a first break point and a second break point to terminate the at least one retaining feature (108) to allow the at least one hair accessory (104) accommodated within the at least one retaining feature (108) to extend over the at least one elevated feature (110).

3. The operable bracelet (100) as claimed in claim 1, wherein the at least one retaining feature (108) further defines a first partial encapsulation edge and a second partial encapsulation edge configured to form the major arc from the first partial encapsulation edge to the second partial encapsulation edge thereby creating the channel around the base layer (112) of the operable bracelet (100).

4. The operable bracelet (100) as claimed in claim 1, wherein the operable bracelet (100) is applied with a plurality of high resolution imagery or logo represented using at least one of illumination and neon lights.

5. The operable bracelet (100) as claimed in claim 1, wherein the bracelet body (106), the at least one retaining feature (108), and the at least one elevated feature (110) are manufactured from a material selected from the group consisting of silicon, elastomer and fluoroelastomer.

6. The operable bracelet (100) as claimed in claim 1, wherein the process adapted for bonding the base layer (112) and the partial encapsulation layer (114) is selected from the group consisting of an injection molding, and a compression molding.

* * * * *